United States Patent [19]

Mukai et al.

[11] 4,266,816

[45] May 12, 1981

[54] LOCK REMOTE CONTROL

[75] Inventors: Tadao Mukai; Teruhika Takatani, both of Hiroshima, Japan

[73] Assignee: Toyo Kogyo Co., Ltd., Hiroshima, Japan

[21] Appl. No.: 59,178

[22] Filed: Jul. 20, 1979

[30] Foreign Application Priority Data

Jul. 20, 1978 [JP] Japan ..... 53/100383[U]
Jul. 24, 1978 [JP] Japan ..... 53/102258[U]

[51] Int. Cl.[3] ..... E05C 3/22

[52] U.S. Cl. ..... 292/129; 292/207; 292/125; 292/DIG. 25; 292/DIG. 43; 292/336.3

[58] Field of Search ..... 292/125, 129, 229, 333, 292/336.3, DIG. 25, DIG. 43, 225

[56] References Cited

U.S. PATENT DOCUMENTS

| | | | |
|---|---|---|---|
| 3,047,326 | 7/1962 | Leslie et al. | 292/341.15 |
| 3,081,078 | 3/1963 | Lohr | 268/74 |
| 3,155,408 | 11/1964 | Peras | 292/DIG. 43 |
| 3,572,790 | 3/1971 | Kapanka | 292/125 |

*Primary Examiner*—Richard E. Moore
*Attorney, Agent, or Firm*—Wenderoth, Lind & Ponack

[57] ABSTRACT

A lock remote control device comprises a lock assembly and a manipulatable unit positioned spaced a distance from the lock assembly. The lock assembly includes a latch lever for selectively locking and unlocking a movable structural element, a first biasing spring for bringing the latch lever in position to lock the movable structural element. The manipulatable unit includes a movable member connected through a latch cable to the latch lever and movable between projected and retracted position, and an actuator operable to permit the movable member to move from the retracted position towards the projected position to bringing the latch lever against the first biasing spring in position to unlock the movable structural element when an external pushing force is applied thereto, but to block the movement of the movable member in the retracted position during the absence of the external pushing force. This movable member is normally biased to assume the projected position by a second biasing spring. The control further comprises a device for resetting the latch lever to the initial position, the reset device including a third biasing spring, the biasing forces of the first and third biasing spring being larger than the biasing force of the second biasing spring.

5 Claims, 22 Drawing Figures

LOCK REMOTE CONTROL

BACKGROUND OF THE INVENTION

The present invention generally relates to a lock remote control and, more particularly, to a device for selectively releasing and latching a lock or catch at a location spaced a distance from the location where such lock or catch is positioned, which is particularly suited for use in a vehicle superstructure.

As is well known to those skilled in the art, the automobile superstructure has various locks or catches for, for example, rear compartment lid or trunk lid, side doors, engine room bonnet or hood, back door and filler lid. In modern automobile vehicles, it is not usual that both of the catches for the hood and the trunk lid can be released by a driver sitting on a driver's seat inside the vehicle superstructure without requiring the driver to approach the hood catch or the lid catch. This is possible because of the employment of a lock remote control. An example of a prior art mechanical lock remote control so far associated with the lock or catch for the trunk lid is shown in FIGS. 1 and 2 of the accompanying drawings.

Referring now to FIGS. 1 and 2, the prior art lock remote control comprises a manipulatable unit M including a pivotally supported manipulatable lever 1 installed on the floor in the automobile superstructure AS at a position laterally of the driver's seat, a flexible transmission cable 2 having one end secured to the manipulatable lever 1, and a lock assembly LA including a pivotally supported latch lever 3 installed on the rear end wall of the automobile superstructure AS, which forms a part of the wall structure defining the rear compartment or trunk together with a hingedly supported trunk lid L. As best shown in FIG. 2, the latch lever 3 has a hook 4 formed at one end thereof and is normally biased by a biasing spring 5 to a latched position, in which the hook 4 is engaged to a striker 6 carried by the trunk lid L to lock the latter in a closed position, but is pivotable against the biasing spring 5 to a release position to disengage the hook 4 from the striker 6 when the manipulatable lever 1 is pivoted from a position shown by the solid line to another position shown by the chain line.

The prior art lock remote control shown in FIGS. 1 and 2 works satisfactorily and effectively, but requires a relatively large force for the manipulatable lever 1 to be manipulated during the release of the lock assembly LA. In addition, once the manipulatable lever 1 has been moved to the position shown by the chain line to release the lock assembly LA, the driver is required to return the lever 1 to the original position shown by the solid line.

If another biasing spring is employed to urge the manipulatable lever 1 towards the original position so that, even after the manipulatable lever 1 has been moved to the position shown by the chain line, it can automatically return to the original position, the increased force sufficient to overcome the sum of the biasing force of the spring 5 and that of the spring used to bias the manipulatable lever 1 is required for the manipulatable lever 1 to be moved to the position shown by the chain line.

In order to overcome the above described disadvantages and inconveniences inherent in the mechanical lock remote control, an electric remote control has been utilized. One type of electric remote control utilizes an electrically operated motor, the rotation of which is utilized to move the latch lever from the latched position to the released position against the biasing spring. Another type of electric remote control utilizes an electrically operated solenoid unit having a plunger operatively coupled to the latch lever with or without the intervention of the flexible transmission cable.

The electric remote control is in fact effective to substantially eliminate the disadvantages and inconveniences inherent in the mechanical remote control, but involves such disadvantages that the use of expensive component parts such as motor or solenoid unit and its associated movable parts is required and that it consume an electric power and, therefore, imposes an extra load on an electric battery.

SUMMARY OF THE INVENTION

Accordingly, the present invention has been made in view to substantially eliminating the disadvantages and inconveniences inherent in the prior art lock remote controls of both mechanically operated and electrically operated types and has for its essential object to provide an improved lock remote control of mechanically operated type which does not require the manipulating force so large as required in the prior art mechaincal remote control to release the latch lever.

Another object of the present invention is to provide an improved lock remote control of the type referred to above, wherein the manipulatable unit can be operated only by a single push, that is, only by the application of a substantial finger pressure of an amount comparable to the finger pressure required to an electric keyboard switch.

A further object of the present invention is to provide an improved lock remote control of the type referred to above, wherein the driver need not manipulate the manipulatable unit at any time other than when the latch lever is desired to be released.

A still further object of the present invention is to provide an improved lock remote control of the type referred to above, which do not require the use of expensive component parts and, therefore, inexpensive as compared with the prior art lock remote control of electrically operated type.

In order to accomplish these and other objects, the present invention provides an improved lock remote control which generally comprises a lock assembly comprising a latch element for selectively locking and unlocking a movable structural element movable between first and second positions, and a first biasing means for urging the latch element to a latched position; a manipulatable unit comprising a movable member movable between third and fourth positions, a second biasing means for urging the movable member to assume the third position, an actuator movable between inoperative and operative position, and a third biasing means for urging the actuator to the inoperative position; a latch cable having its opposed ends secured respectively to the latch element and the movable member; shifting means supported for movement between fifth and sixth positions; and a fourth biasing means operatively associated with the movable structural element and acting to urge the shifting means towards the sixth position.

So far as the present invention is applied to an automobile superstructure, the movable structural element referred to above and hereinafter may be any one of the rear compartment lid or trunk lid, side doors, engine room bonnet or hood, back door and filler lid and includes an engagement element which is, when the movable structural element is held in the first position and the latch element is, at this time, held in the latched position, engaged with the latch element to lock the movable structural element in the first position.

The first biasing means employed in the lock assembly for urging the latch element to the latch position is of a type capable of exerting a predetermined biasing force smaller than that of the second biasing means used to urge the movable member to assume the third position, however, the sum of the biasing forces of the respective first and fourth biasing means being so larger than that of the second biasing means that the movable member, which has been moved to the third position by the action of the second biasing means to move the latch element to a released position against the first biasing means with the actuator moved to the operative position, can be returned to the fourth position to allow the actuator to return to the inoperative position. The actuator when and so long as held in the inoperative position blocks the movement of the movable member from the fourth position towards the third position and, therefore, as the movable structural element once moved to the second position during the positioning of the latch element to the released position is moved towards the first position, the latch element is moved from the latched position towards the released position and then back to the latched position by the engagement element of the movable structural element to lock the latter.

The shifting means is, when the movable structural element is moved from the first position towards the second position, biased to the sixth position by the action of the fourth biasing means and, when so biased, transmits the biasing force of the fourth biasing means to the latch element to move the latch element, which is then moved to the released position by the action of the second biasing means, towards the latched position with the movable member consequently moved from the third position towards the fourth position against the second biasing means. This is possible because, as hereinbefore described, the sum of the biasing forces of the first and fourth biasing means is larger than the biasing force of the second biasing means.

The movement of the movable member in the manipulatable unit is transmitted to the latch element through a latch cable extending between the lock assembly and the manipulatable unit. This latch cable may extend in the vehicle superstructure in a zig-zag manner and, for this purpose, a protective sheath may be employed through which it extends.

According to the present invention, the manipulatable unit may be assembled in a compact size and, therefore, it can be installed on a dashboard in front of the driver's seat. Alternatively, it may be installed on the floor inside the vehicle superstructure so that it can be operated by either the foot or the hand of the driver.

BRIEF DESCRIPTION OF THE DRAWINGS

These and other objects of the present invention will become apparent from the following description taken in conjunction with preferred embodiments thereof with reference to the accompanying drawings, in which.

DETAILED DESCRIPTION OF THE INVENTION

Figure 1:
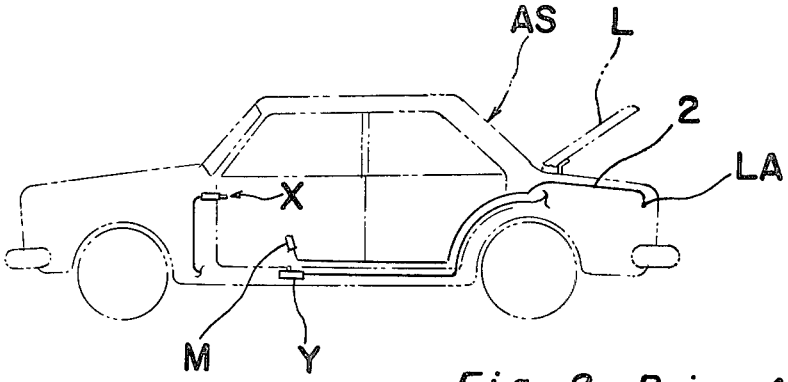
Fig. 1 Prior Art
FIG. 1 is a schematic side view of a vehicle superstructure with the prior art lock remote control installed therein.

Before the description of the present invention proceeds, it is to be noted that like parts are designated by like reference numerals throughout the accompanying drawings.

Referring first to FIGS. 3 to 6, there is shown a lock remote control as applied for selectively locking and unlocking a trunk lid L. The trunk lid L has one side edge hinged through at least one arm La to a bracket B fast with a vehicle superstructure AS and is, therefore, pivotable between closed and opened positions as is well known to those skilled in the art. Although not shown, the trunk lid L is normally urged by a spring element to assume the opened position, which spring element may be a torsion spring mounted on a hinge pin about which the lid L pivots.

The lock remote control shown in FIGS. 3 to 6 comprises a manipulatable unit M installed on, for example, a dashboard as shown by X in FIG. 1, a lock assembly LA and a latch cable 2 extending between the manipulatable unit M and the lock assembly LA. The manipulatable unit M comprises a generally cylindrical casing 10 having one end closed and the other end opened. This casing 10 is secured to a wall member 11, for example, a dashboard panel, with its opened end closed by said wall member 11 and, hence, protrudes from the wall member 11 in a direction, for example, facing the driver's seat inside the vehicle superstructure AS. The casing 10 has a generally cylindrical pocket 12 defined therein at a position adjacent the closed end thereof and protruding radially outwardly of the casing 10, and an opening 13 defined in the casing 10 in coaxial and opposed relation to the cylindrical pocket 12.

Figure 3:
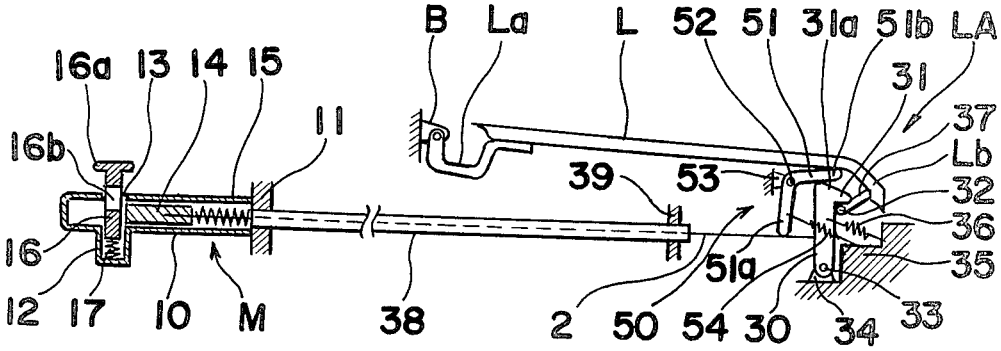
FIGS. 3 to 6 are diagrams showing a lock remote control according to a first preferred embodiment of the present invention in different operative positions.
Figure 4:
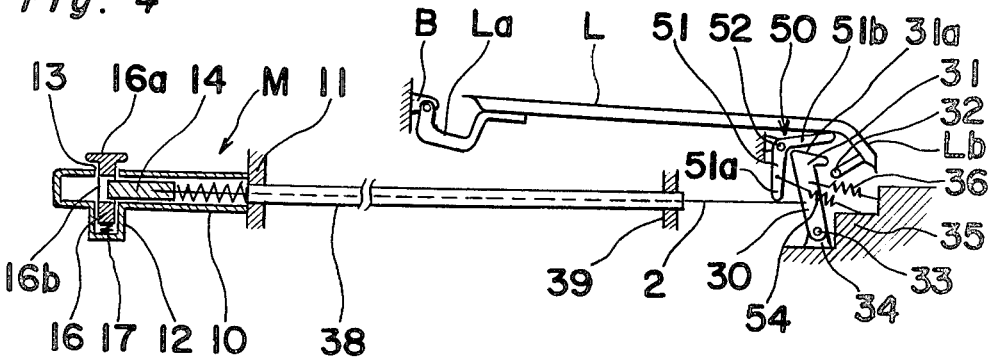
Figure 5:
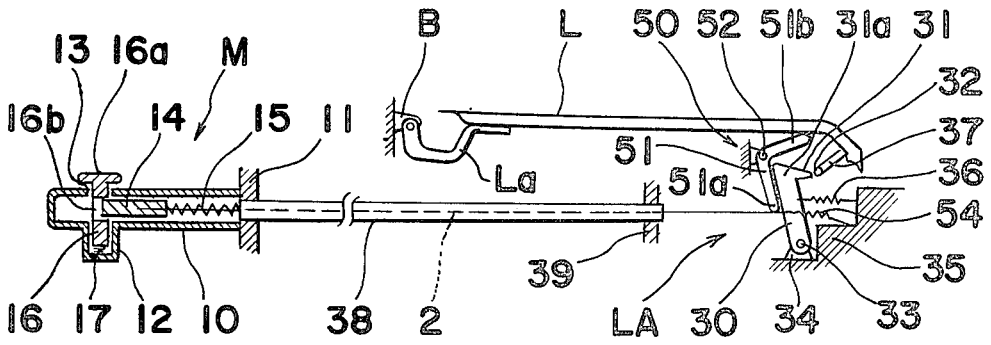
Figure 6:
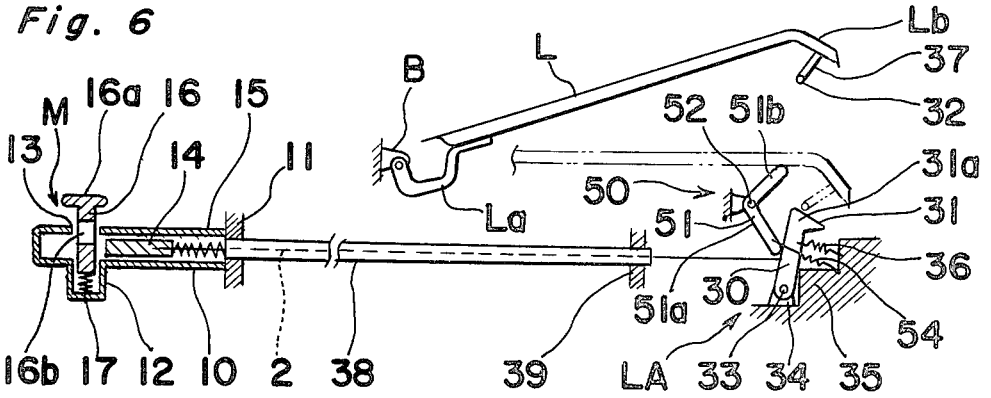

The manipulatable unit M further comprises a movable block 14 accommodated within the casing 10 for movement between retracted and projected positions and to which one end of the latch cable 2 is rigidly connected, a biasing spring 15 interposed within the casing 10 between the wall member 11 and the movable block 14 for urging the movable block 14 to assume the projected position, an actuator which is, in the instance as shown in FIGS. 3 to 6, in the form of a substantially elongated blocking piece 16 supported for movement between inoperative and operative positions in a manner as will be described later, and a biasing spring 17 for urging the blocking piece 16 towards the inoperative position. The blocking piece 16 has one end formed with a head portion 16*a* accessible to the hand of an automobile driver and the other end slidingly situated within the cylindrical pocket 12, a substantially intermediate portion thereof extending through the opening 13 and traversing the direction of movement of the movable block 14 within the casing 10. This blocking piece 16 is normally biased to the inoperative position, as shown in FIGS. 3 and 6, by the biasing spring 17 which is housed within the cylindrical pocket 12 and interposed between the end of the blocking piece 16 opposite to the head portion 16*a* and the bottom of the pocket 12. The blocking piece 16 has a transverse passage 16*b* defined therein at such a position that, when said blocking piece 16 is moved to the operative position, such as shown in FIGS. 4 and 5, against the biasing spring 17 by the application of a finger pressure to the head portion 16*a*, the transverse passage 16*b* is aligned with the longitudinal axis of the casing 10. The transverse passage 16*b* in the blocking piece 16 is of such a cross section that the movable block 14 can project thereinto by the action of the biasing spring 15 only when the blocking piece 16 is moved to the operative position.

It is to be noted that, when the blocking piece 16 is in the inoperative position, the transverse passage 16*b* is out of alignment with the longitudinal axis of the casing 10. Although not shown, the blocking piece 16 is to be understood as having any known stopper means necessary to avoid the separation or detachment of the blocking piece 16 from the casing 10. The separation or detachment of the blocking piece 16 from the casing 10 can also be avoided by connecting the ends of the biasing spring 17 respectively to the bottom of the pocket 12 and the end of the blocking piece 16 in a manner known to those skilled in the art.

The lock assembly LA comprises a latch lever 30 having one end formed into a hook 31 engageable with a striker 32 which may be in the form of a pin member. The other end of the latch lever 30 is pivotally connected by means of a pivot pin 33 to a bracket 34 rigidly mounted on a rear end wall 35 of the vehicle superstructure AS which forms a part of the wall structure defining the trunk casing and which is positioned in opposite relation to the wall to which the trunk lid L is hinged in the manner described above. The latch lever 30 is pivotable between latched and released positions about the pivot pin 33 but is normally biased to assume the latched position by the action of a biasing spring 36 having one end rigidly connected to a substantially intermediate portion of the latch lever 30 and the other end rigidly connected to the rear end wall 35.

The striker 32 is rigidly carried by the trunk lid L and, for this purpose, a pair of bracket members 37 each having one end rigidly connected to the corresponding end of the striker 32. The other ends of the respective bracket members 37 are rigidly secured to a downwardly curved rear edge portion Lb of the trunk lid L and protrudes therefrom towards the interior of the trunk casing. The striker 32 and the latch lever 30 are so positioned relative to each other that, when the trunk lid L is pivoted to the closed position as shown in FIG. 3, the hook 31 of the latch lever 30 is firmly engaged to the striker 32 to lock the trunk lid L and, when the latch lever 30 is pivoted from the latched positon towards the released position against the biasing spring 36, the striker 32 can disengage therefrom to allow the trunk lid L to be automatically moved through a predetermined angular distance from the closed position towards the opened position by the action of the lid biasing spring element (not shown).

For moving the latch lever 30 between the released and latched positions in a manner as will subsequently be described, a substantially intermediate portion of the latch lever 30 is rigidly connected to the other end of the latch cable 2. The length of the latch cable 2 is so selected that, when and so long as the latch lever 30 is held in the latched position with the hook 31 engaging the striker 32 as shown in FIG. 3, the movable block 14 being biased by the biasing spring 15 is held in the retracted position with its free end contacting or spaced a slight distance from the blocking piece 16 in the inoperative position. Depending upon the distance between the respective locations where the manipulatable unit M and the lock assembly LA are installed and/or the purpose for which the lock remote control is employed, a protective sheath 38 through which the latch cable 2 extends may be employed between the wall member 11 and a wall member 39 adjacent the lock assembly LA. The use of the sheath 38 is particularly advantageous where the latch cable 2 extends in a substantially zig-zag manner such as within the vehicle superstructure AS, in substantially avoiding any possible frictional wear of the latch cable 2 and/or frame members forming the vehicle superstructure.

It is to be noted that the biasing spring 15 within the casing 10 of the manipulatable unit M is of a type capable of exerting a biasing force larger than that of the biasing force 36 in the lock assembly LA so that, when the blocking piece 16 is moved from the inoperative position to the operative position against the biasing spring 17 as shown in FIG. 4, the movable block 14 being biased by the biasing spring 15 can project into the transverse passage 16*b* in the blocking piece 16 with the latch cable 2 consequently pulled in a direction towards the manipulatable unit M to draw the latch lever 30 from the latched position towards the released position against the biasing spring 36 as shown in FIG. 4.

For returning the movable block 14, which has been moved to the projected position with its free end situated within the transverse passage 16*b* in the blockping piece 16, back to the retracted position against the biasing spring 15 so that the latch lever 30 can be biased to the latched position by the action of the biasing spring 36, the lock remote control according to the present invention employs a reset means 50 operable only when the truck lid L is moved the predetermined angular distance from the closed position towards the opened position. The reset means 50 comprises, in the embodiment shown in FIGS. 3 to 6, a substantially L-shaped reset lever 51 pivotally mounted at its intermediate bent portion on a pivot pin 52 which is secured through a bracket 53 to the rear end wall 35 at a position opposed to the portion of the rear end wall 35 where one end of the biasing spring 36 is rigidly connected. This L-shaped reset lever 51 is pivotable about the pivot pin 52 between set and reset positions in the same plane in which the latch lever 30 pivots, but is normally biased to assume the reset position by the action of a reset spring 54 having one end rigidly connected to one end 51*a* of the reset lever 51 and the other end connected to the rear end wall 35. The reset lever 51 has the other end 51*b* which, when the trunk lid L is in the closed position as shown in FIG. 3, is engaged to the trunk lid L with the reset lever 51 consequently held in the set position against the reset spring 54. However, as will be described later, the end 51*a* of the reset lever 51 is engageable with the latch lever 30 to transmit the biasing force of the reset spring 54 to the latch lever 30 when and after the trunk lid L has been moved the predetermined angular distance from the closed position towards the opened position. This condition is illustrated in FIGS. 5 and 6.

The reset spring 54 is of a type capable of exerting a biasing force which may be either smaller or larger than that of the biasing spring 15. Where the reset spring exerts the biasing force smaller than the biasing force of the biasing spring 15, it must be such that the sum of the respective biasing forces of the springs 36 and 54 is larger than the biasing force of the biasing spring 15, so that, when and after the trunk lid L has been moved the predetermined angular distance from the closed position towards the opened position, the L-shaped reset lever 51 applies the biasing force of the reset spring 54 to the latch lever 30 with the end 51*a* slidingly engaged to said latch lever 30 to move the latch lever 30 from the released position towards the latched position in cooperation with the biasing spring 36 overcoming the biasing force of the biasing spring 15 within the casing 10.

While the lock remote control embodying the present invention is constructed as hereinbefore described, it operates in the following manner.

Starting from the condition as shown in FIG. 3, wherein the blocking piece 16 is in the inoperative position and the trunk lid L is in the closed position with the hook 31 of the latch lever 30 engaged to the striker 32, the application of a finger pressure to the head portion 16*a* of the blocking piece 16 results in movement of the blocking piece 16 from the inoperative position towards the operative position against the biasing spring 17 as shown in FIG. 4. Upon arrival, or shortly before the arrival, of the blocking piece 16 to the operative position, the movable block 14 is thrusted into the transverse passage 16*b* in the blocking piece 16 by the action of the biasing spring 15. This movement of the movable block 14 from the retracted position to the projected position draws the latch cable 2 in a direction towards the manipulatable unit M and, consequently, the latch lever 30 is pivoted from the latched position towards the released position against the biasing spring 36 exerting the smaller biasing force than that of the biasing spring 15.

In this way, the hook 31 of the latch lever 30 is disengaged from the striker 32 as shown in FIG. 4 on one hand and the trunk lid L is pivoted from the closed position towards the opened position through the predetermined angular distance by the action of the lid biasing spring (not shown). It is to be noted that, without the lid biasing spring, the trunk lid L can be pivoted the predetermined angular distance towards the opened position by the action of the reset spring 54 transmitted thereto through the end 51*b* of the reset lever 51 if the reset spring 54 is of a type capable of exerting the biasing force sufficient to lift the lid L. This condition is substantially shown in FIG. 5.

Immediately after the striker 32 has completely been disengaged from the hook 31 of the latch lever 30 as shown in FIG. 5, the end 51*a* of the reset lever 51 being pivoted from the set position towards the reset position by the action of the reset spring 54 contacts the latch lever 30 to apply the biasing force of the reset spring 54 thereto. At the time the trunk lid L has been moved the predetermined angular distance towards the opened position, the biasing forces of the springs 36 and 54 simultaneously acts on the latch cable 2 to draw the latter in a direction towards the lock assembly LA against the biasing spring 15 and, therefore, the movable block 14 in the projected position is moved back towards the retracted position with its free end separating away from the transverse passage 16*b* in the blocking piece 16 as shown in FIG. 6 while the latch lever 30 is brought to the latched position. Upon disengagement of the movable block 14 from the transverse passage 16*b* in the manner described above, the blocking piece 16 is moved back to the inoperative position by the action of the biasing spring 17.

In order to enable the blocking piece 16 to be assurredly moved from the operative position towards the inoperative position with no contact taking place between the movable block 14 and the blocking piece 16 and also to enable the employment of the biasing spring 17 of a type exerting a biasing force so small as to provide no appreciable resistance to the movement of the blocking piece 16 from the inoperative position towards the operative position, the latch lever 30 is preferably so designed as to be pivoted through a predetermined angle about the pivot pin 33 beyond the latched position in a direction counter to the direction towards the released position such as shown in FIG. 6.

Where the trunk lid L once opened in the manner described above is desired to be brought to the closed position, what is to be done is to push the trunk lid L in the opened position to move said lid L towards the closed position. No sooner than the end 51*b* of the reset lever 51 in the reset position contacts the trunk lid L being moved towards the closed position, the striker 32 carried by the trunk lid L contacts an inclined ridge 31*a* defined in the hook 31 in opposition to the pivot pin 33 in a manner substantially as shown by the chain line in FIG. 6. Subsequent to the contact of the end 51*b* of the reset lever 51 to the inclined ridge 31*a* in the hook 31 and as the trunk lid L is further moved towards the closed position, the striker 32 causes the latch lever 30 to pivot towards the released position against the biasing spring 36 and, substantially at the same time, the trunk lid L being moved towards the closed position causes the reset lever 51 to pivot from the reset position towards the set position against the reset spring 54 with the end 51*a* thereof disengaging from the latch lever 30. This continues until the striker 32 is trapped by the hook 31, at which time the latch lever 30 pivoted a distance towards the released position is instantaneously pivoted to the latched position by the action of the biasing spring 36 to lock the trunk lid L in the closed position as shown in FIG. 3.

In the foregoing embodiment, the reset means 50 has been described and shown as constituted by the substantially L-shaped, pivotally supported reset lever 51.

Figure 9:
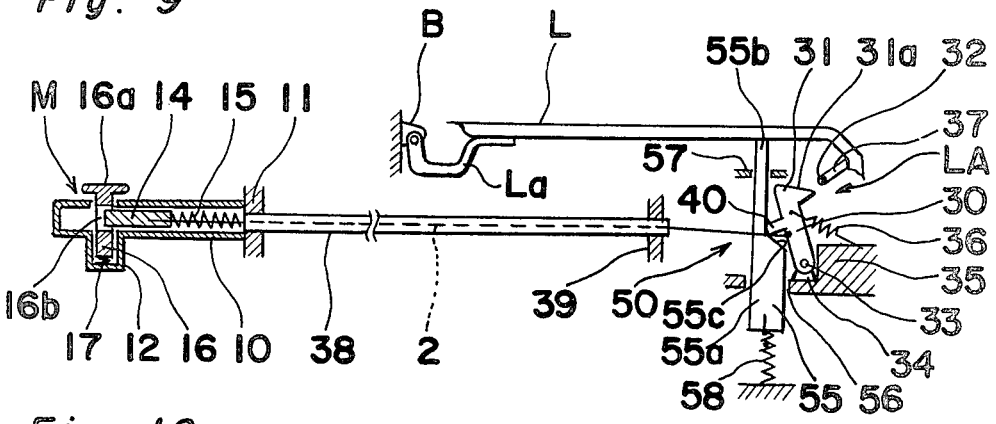
Figure 10:
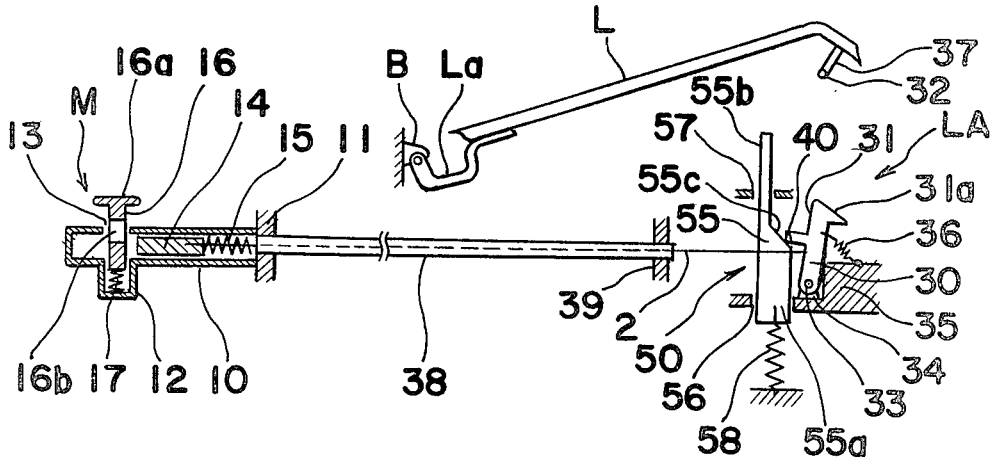
Figure 11:
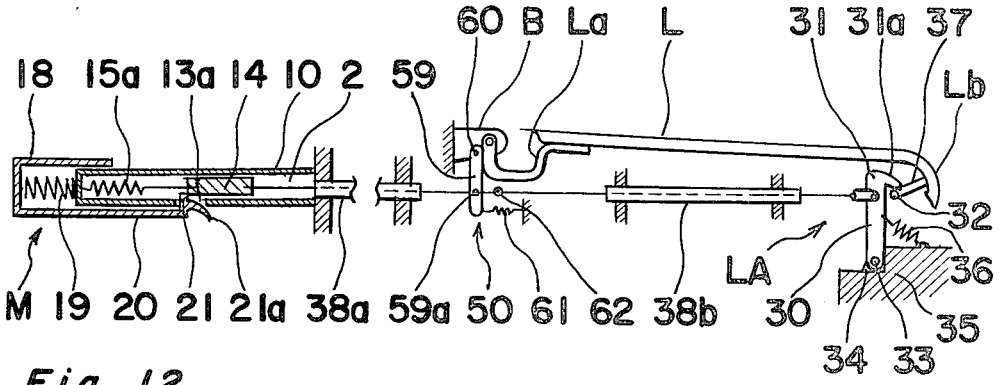
Figure 12:
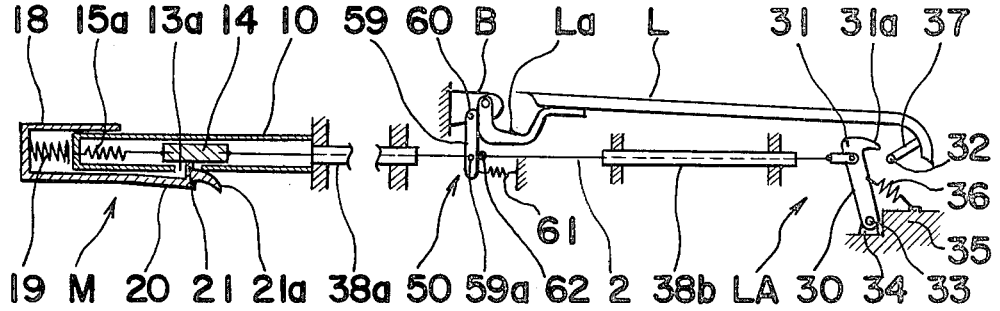
FIGS. 12 and 13 are diagrams similar to FIG. 5 or 9 and FIG. 6 or 10, showing the lock remote control according to a third preferred embodiment of the present invention.
Figure 13:
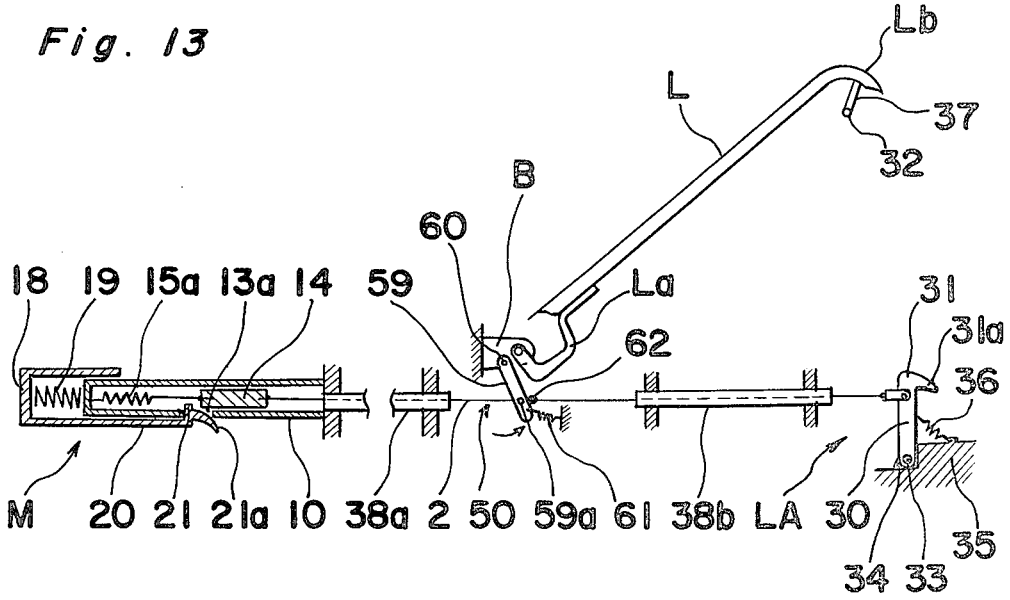

However, it may be constituted by either a slidable lever such as shown in FIGS. 7 to 10 or a pivotally supported lever such as shown in FIGS. 11 to 13, which will now be described.

Figure 7:
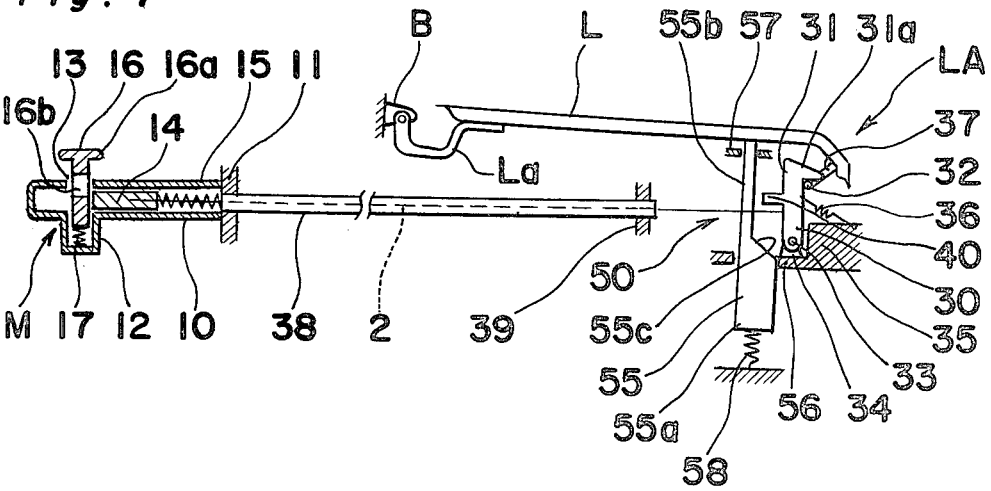
FIGS. 7 to 10 are diagrams similar to FIGS. 3 to 6, showing the lock remote control according to a second preferred embodiment of the present invention.
Figure 8:
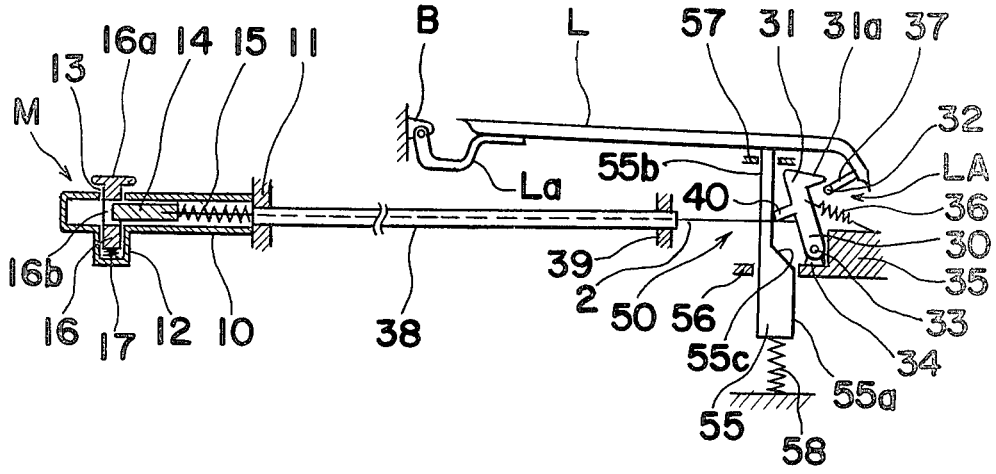

Referring first to FIGS. 7 to 10, the reset means 50 comprises a reset lever 55 having its opposed ends 55*a* and 55*b* enlarged and reduced in width, respectively, and also having an inclined cam edge defined at 55*c* on one side edge thereof, said cam edge 55*c* facing towards the latch lever 30. This reset lever 55 is supported by at least one pair of guide members 56 and 57 fast with the rear end wall 35 in any suitable manner for sliding movement between the set and reset positions in the same plane in which the latch lever 30 pivots, but is normally biased to assume the reset position by the action of a reset spring 58 which functionally corresponds to the reset spring 54 shown in FIGS. 3 to 6. The end 55*b* of the reset lever 55 is, when the trunk lid L is in the closed position as shown in FIGS. 7 and 8, engaged to the trunk lid L with the reset lever 55 consequently held in the set position against the reset spring 58.

To render the reset lever 55 cooperative with the latch lever 30 in such a way as to transmit the biasing force of the reset spring 58 to the latch lever 30 when the trunk lid L is moved from the closed position towards the opened position with the latch lever 30 held in the released position incident to the movement of the blocking piece 16 to the operative position as shown in FIG. 8, so that the latch lever 30 can be returned to the latched position while the blocking piece 16 can return to the inoperative position, the latch lever 30 in the instance as shown in FIGS. 7 to 10 is formed with a feeler 40 slidingly engageable with the inclined cam edge 55*c*. The inclined cam edge 55*c* and the feeler 40 are so designed relative to each other that, subsequent to the complete disengagement of the striker 32 from the hook 31 of the latch lever 30 being pivoted to the released position and as the trunk lid L is moved from the closed position towards the opened position, the reset lever 55 is biased towards the reset position by the action of the reset spring 58 with the inclined cam edge 55*c* held in slidingly contact with the tip of the feeler 40 thereby causing the latch lever 30 to pivot back to the latched position in such a sequence as shown in FIGS. 9 and 10.

As is the case with the reset lever 51 shown in FIGS. 3 to 6, the reset lever 55 can be returned to the set position against the reset spring 58 when the trunk lid L is pivoted from the opened position to the closed position.

From the foregoing, it will readily be seen that even the lock remote control according to the embodiment shown in FIGS. 7 to 10 operates in a manner substantially similar to that shown in FIGS. 3 to 6.

Referring now to FIGS. 11 to 13, the reset means 50 is positioned in the vicinity of the hinge about which the trunk lid L pivots between the closed and opened positions. This means that there may be a substantial distance between the location of the lock assembly LA and that of the reset means 50 and, in such case, the sheath for the protection of the latch cable 2 may be composed of two sheath segments such as shown by 38*a* and 38*b* in FIGS. 11 to 13, the sheath segment 38*b* being positioned between the manipulatable unit M and the reset means 50 while the sheath segment 38*b* is positioned between the reset means 50 and the lock assembly LA.

The reset means 50 shown in FIGS. 11 to 13 comprises a generally straight reset lever 59 having one end pivotally connected to the bracket B through a hinge pin 60 and the other end connected to a reset spring 61 so operable as to bias the reset lever 59 to assume a reset position as shown in FIG. 13. The support arm La, through which the trunk lid L is hinged to the bracket B as herinbefore described, and the reset lever 59 are so positioned and so shaped that, when the trunk lid L is in the closed position, a portion of the support arm La adjacent the reset lever 59 contacts the reset lever 59 thereby urging the reset lever 59 to position at a set position, as shown in FIGS. 11 and 12, against the reset spring 61.

The reset lever 59 has a throughhole 59*a* defined therein at a position remote from the hinge pin 60, the latch cable 2 being loosely extending through said throughhole 59*a*. Cooperative with the reset lever 59 is a stop element 62 of a size larger than the diameter of the throughhole 59*a*, said stop element 62 being rigidly mounted on, or otherwise secured to, the latch cable 2 on one side of the reset lever 59 adjacent the lock assembly LA. The position of the stop element 62 on the latch cable 2 is so spaced from the reset lever 59, particularly, the throughhole 59*a*, that only when the latch lever 30 is moved to the released position with the latch cable 2 drawn in a direction close towards the manipulatable unit M as a result of the manipulation of the manipulatable unit M, the stop element 62 abuts or contacts the reset lever 59 as best shown in FIG. 12.

From FIG. 13, it will readily be seen that, when the trunk lid L is moved from the closed position towards the opened position with the latch lever 30 moved to the released position, the reset lever 59 is biased by the action of the reset spring 61 towards the reset position while simultaneously drawing the latch cable 2 in a direction close towards the lock assembly LA. This is possible because, when the latch lever 30 has been moved to the released position, the stop element 62 is engaged to the reset lever 59 so that the subsequent movement of the reset lever 59 from the set position towards the reset position can be transmitted to the latch cable 2.

The manipulatable unit M utilizable together with the reset means 50 of the construction shown in FIGS. 11 to 13 may be of a construction identical with that shown in any one of FIGS. 3 to 6 and FIGS. 7 to 10. However, in FIGS. 11 to 13, the manipulatable unit M is shown as comprising a tension spring 15*a* in contrast to the biasing spring 15 which has been shown in the form of a compression spring in FIGS. 30 to 10. This tension spring 15*a* has one end rigidly secured to the closed end of the casing 10 and the other end rigidly secured to the movable block 14.

The actuator empolyed in the manipulatable unit M shown in FIGS. 11 to 13 comprises a cap member 18 mounted on the closed end of the casing 10 for telescopical movement between inoperative and operative positions, but normally biased to the inoperative position by the action of a biasing spring 19 interposed within the cap member 18 between the respective closed ends of the cap member 18 and the casing 10.

For blocking the movable block 14 in the retracted position against the tension spring 15*a*, corresponding in function to the biasing spring 15 shown in FIGS. 3 to 10, when and so long as the cap member 18 is held in the inoperative position, and also for permitting the movable block 14 to move from the retracted position towards the projected position as pulled by the tension spring 19, the casing 10 has a slot 13*a* axially defined therein on one hand and, on the other hand, the cap member 18 has an elongated resilient body 20 generally extending in parallel relation to the longitudinal axis of the casing 10 and having one end rigidly secured to, or otherwise formed integrally with, the cap member 18 and the other end integrally formed with a finger 21. The finger 21 extends at right angles to the elongated resilient body 20 and protrudes through the slot 13*a* into the interior of the casing 10. The finger 21 has a substantially intermediate portion integrally formed with a release projection 21*a* protruding therefrom in a direction away from the cap member 18. This release projection 21*a* is so shaped and so curved as to retract the free end of the finger 21 out of the interior of the casing 10, when the cap member 18 is moved from the inoperative position towards the operative position, to allow the movable block 14 in the retracted position to move towards the projected position as pulled by the tension spring 15*a*. More specifically, as shown in FIG. 11, when the cap member 18 is held in the inoperative position, the free end of the finger 21 is in position to block the movement of the movable block 14 from the retracted position towards the projected position in contact with the free end of the movable block 14. However, as the cap member 18 is moved from the inoperative position towards the operative position in an attempt to bring the latch lever 30 to the released position to unlock the trunk lid L, the movable block 14 is moved a predetermined distance beyond the retracted position in a direction away from the projected position of the movable block 14 in contact with the free end of the finger 21 against the tension spring 15*a* on one hand and, on the other hand, the release projection slidingly ride over a portion of the wall forming the casing 10, which corresponds to one end of the slot 13*a*, thereby deforming the elongated resilient body 20 against the resiliency of said body 20 as shown in FIG. 12. At the time of completion of the movement of the cap member 18 to the operative position, the free end of the finger 21 is disengaged from the movable block 14 to allow the latter to be thrusted towards the projected position by the action of the tension spring 15*a*.

The movable block 14 once moved to the projected position as shown in FIG. 12 can be brought back to the retracted position against the tension spring 15*a* when the latch cable 2 is drawn in a direction close towards the lock assembly LA incident to the movement of the trunk lid L from the closed position towards the opened position in the manner as hereinbefore described.

Where the elongated resilient body 20 is integrally formed with the cap member 18, the employment of a synthetic resin is preferred as a material for the assembly of the cap member 18, the body 20 and the finger 21. In addition, so far as the manipulation unit M of the construction shown in FIGS. 11 to 13 is involved, care must be take such as to minimize the distance through which the movable block 14 is moved backwards beyond the retracted position against the tension spring 15*a* in contact with the free end of the finger 21 during the initial stage of the application of the pushing force to the cap member 18 to move the latter towards the operative position. This can readily be achieved by suitably designing the finger 21 such that the free end of the finger 21 can be retracted out of the interior of the casing 10 by the single instantaneous push, not the prolonged push such as required in moving the blocking piece 16 shown in FIGS. 3 to 10 until the movable block 14 projects into the transverse passage 16*b*.

In practice, the reset lever 59 forming the reset means 50 shown in FIGS. 11 to 13 so far illustrated must be a construction having its opposed end portions lying in two different planes perpendicular to each other. Specifically, the end portion of the reset lever 59 adjacent the reset spring 61 has a surface plane perpendicular to the latch cable 2 while the end portion of the same reset lever 59 adjacent the hinge pin 60 has a surface plane at right angles to the first mentioned end portion.

Figure 14:
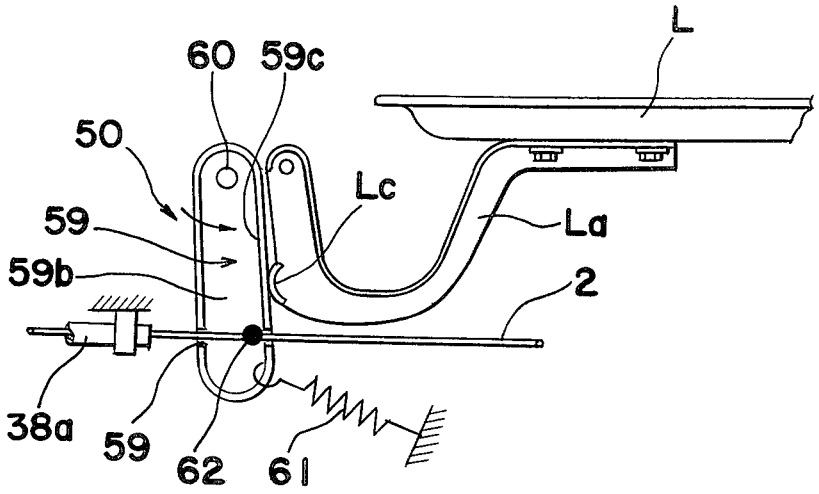
FIG. 14 is a front elevational view a reset lever employed in any one of the second and third embodiments of the present invention.
Figure 15:
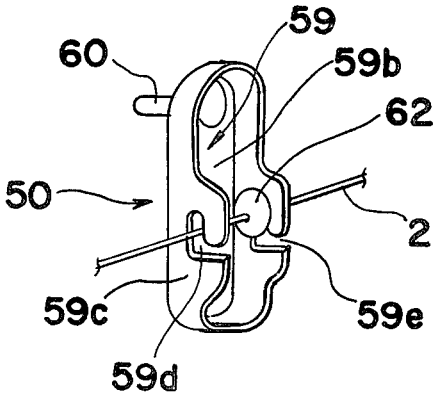
FIG. 15 is a perspective view of the reset lever shown in FIG. 14.

However, it is preferred to construct the reset lever 59 in a manner as shown in FIGS. 14 and 15, reference to which will now be made.

Referring now to FIGS. 14 and 15, the reset lever 59 comprises a substantially elongated plate body 59*b* having its peripheral edge formed with a wall 59*c* protruding in a direction at right angles to the plane of the elongated plate body 59*b*. The opposed side portions of the wall 59*c* one on each side of the lengthwise direction of the elongated plate body 59*b* are formed respectively with substantially L-shaped slots 59*d* and 59*e* with the latch cable 2 loosely extending through respective portions of the slots 59*d* and 59*e* which extend in parallel relation to the lengthwise direction of the elongated plate body 59*b*. The stop element 62 rigidly mounted on the latch cable 2 is, when the reset lever 59 of the construction shown in FIGS. 14 and 15 is employed in practice, situated within a space between the opposed side portions of the wall 59*c*, the space between said opposed side portions of the wall 59*c* being so selected and so sized as to correspond to the distance between the stop element 62 and the reset lever 59 which has been described with reference to FIGS. 10 to 13.

As best shown in FIG. 14, the support arm La may have an engagement projection Lc defined at, or otherwise rigidly secured to, a portion of the support arm Lc where it contacts the reset lever 59, so that the movement of the trunk lid L can be transmitted to said reset lever 59 through said engagement projection Lc.

In the embodiment shown in FIGS. 3 to 6, the end 51*a* of the reset lever 51 has been described as engageable with the latch lever 31. However, it is possible to transmit the movement of the reset lever 51 from the set position towards the reset position incident to the movement of the trunk lid L from the closed position towards the opened position to the latch lever 31 through a portion of the latch cable 2, an example of which will be described with reference to FIG. 16.

Figure 16:
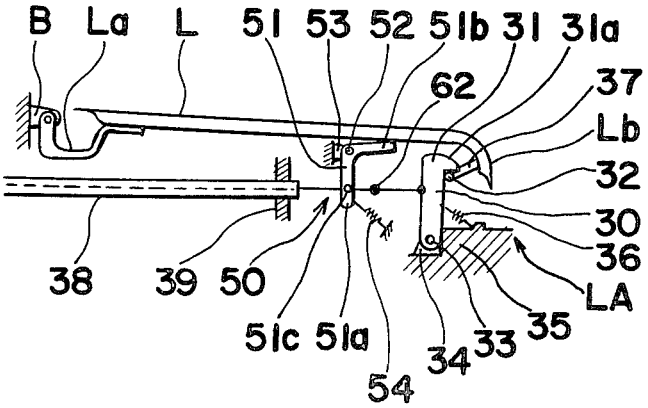
FIG. 16 is a diagram showing a modification of a lock assembly employed in the first embodiment of the present invention

Referring to FIG. 16, while the reset means 50 of the construction shown in FIG. 16 is positioned substantially intermediate the bracket B and the lock assembly LA, the end portion 51*a* of the reset lever 51 is formed with a throughhole 51*c* through which the latch cable 2 loosely extends. Cooperative with that end portion 51*a* of the reset lever 51 is a stop element 62 rigidly mounted on the latch cable 2 in the manner as hereinbefore described with reference to FIGS. 11 to 13.

It will readily be seen that, when the latch lever 31 is moved to the released position and the trunk lid L is subsequently moved from the closed position towards the opened position, the reset lever 51 causes the latch lever 31 to return to the latched position by the action of the biasing spring 36 with the end portion 51*a* drawing the cable 2 in a direction towards the latch assembly LA in contact with the stop element 62.

It is to be noted that that end portion 51*a* of the reset lever 51 may be assembled to assume such a construction as described with reference to and shown in FIGS. 14 and 15.

Figure 17:
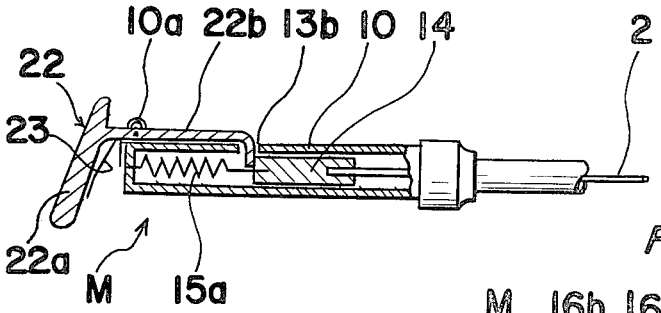
FIGS. 17 to 19 are longitudinal sectional views showing different designs of a manipulatable unit employed in the present invention.
Figure 18:
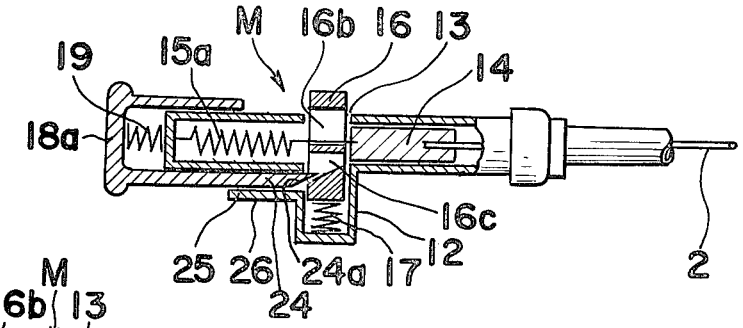
Figure 19:
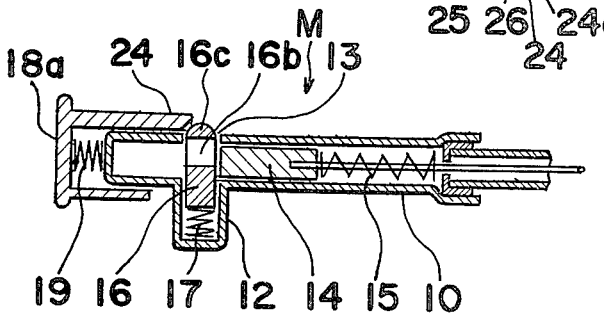

The manipulatable unit M of the construction shown in FIGS. 11 to 13 may be modified to assume such a construction as shown in any one of FIGS. 17 and 18 whereas the manipulatable unit M of the construction shown in FIGS. 1 to 10 may be modified to assume such a construction as shown in FIG. 19. Specifically, the manipulatable unit M of the construction shown in FIG. 18 may be considered a combined version of the devices respectively shown in FIGS. 3 to 10 and FIGS. 11 to 13.

Referring first to FIG. 17, the cylindrical casing 10 has an aperture 13*b* defined therein at a substantially intermediate portion thereof and also has a pair of circumferentially spaced lugs 10*a* formed on the outer peripheral surface thereof at a position adjacent the closed end thereof. A trigger lever 22, constituting the actuator of the manipulatable unit M and comprised of a pressure receiving portion 22*a*, which may be in the form of a handle or a button, and an elongated trigger bar 22*b* having one end formed integrally with, or otherwise rigidly secured to, the pressure receiving portion 22*a* and the other end bent. This trigger lever 22 is pivotally mounted on the casing 10 with a portion of the trigger bar 22 adjacent the joint between it and the pressure receiving portion 22*a* so hinged to the lugs 10*a* that the trigger lever 22 can pivot between an inoperative position, in which the bent end of the trigger bar 22*b* projects into the interior of the casing 10 to block the movable block 14 in the retracted position as shown, and an operative position in which the bent end of the trigger bar 22*b* is retracted out of the interior of the casing 10 to allow the movable block 14 to move from the retracted position towards the projected position as pulled by the tension spring 15*a*. The trigger lever 22 is, however, normally biased to assume the inoperative position by the action of a return spring 23 which is shown in the form of a leaf spring. It is to be noted that, in place of the tension spring 15*a*, a compression spring may be employed in which case the compression spring should be positioned in the manner described with reference to and shown in FIGS. 3 to 10. This possibility can equally be applicable to the manipulatable unit M of the construction shown in FIGS. 11 to 13.

Referring now to FIG. 18, the blocking piece 16 has an additional passage 16*c* defined therein in juxtaposed relation to the transverse passage 16*b*, said passage 16*c* being so shaped as hereinafter described. A cap member 18*a*, similar to the cap member 18 shown in FIGS. 11 to 13, is mounted on the closed end portion of the casing 10 for telescopical movement between projected and retracted positions and is normally biased to the projected position by the action of the biasing spring 19. This cap member 18*a* has an elongated projection 24 extending therefrom and having its free end inclined at 24*a*. With the cap member 18*a* telescopically movably mounted on the closed end portion of the casing 10 and so long as it is held in the projected position as shown, the elongated projection 24 extends through a guide passage 25, defined by the outer peripheral wall surface of the casing 10 and a substantially U-sectioned guide wall member 26 radially outwardly protruding from the wall of the cylindrical pocket 12 in a direction parallel to the longitudinal axis of the casing 10, and terminates with the tip of the inclined free end situated within the passage 16*c*.

The passage 16*c* in the blocking piece 16 is so shaped and so cooperative with the inclined surface 24*a* at the free end of the elongated projection 24 that, when the cap member 18*a* is moved from the projected position towards the retracted position against the biasing spring 19 in an attempt to unlock the trunk lid L, the free end of the projection 24 projects into the passage 16*c* with the inclined surface 24*a* causing the blocking piece 16 to move from the inoperative position towards the operative position against the biasing spring 17.

From the foregoing, it will readily be seen that, only by applying a finger pressure to the cap member 18*a* in a direction counter to the direction in which the biasing force of the spring 19 acts, the blocking piece 16 can be moved from the inoperative position towards the operative position against the biasing spring 17 to allow the movable block 14 to thrust into the transverse passage 16*b* as pulled by the tension spring 15*a*.

The manipulatable unit M of the construction shown in FIGS. 3 to 10 requires the direct application of the finger pressure to the head portion of the blocking piece 16 in a direction parallel to the direction of movement of the blocking piece 16. However, in the construction shown in FIG. 19, the free end of the projection 24 fast with the cap member 18*a* is so designed as to depress, that is, move, the blocking piece 16 from the inoperative position towards the operative position against the biasing spring 17 in sliding contact with a rounded end 16*c* of the blocking piece 16 during the movement of the cap member 18*a* from the projected position towards the retracted position against the biasing spring 19.

It is to be noted that the manipulatable unit M of the construction shown in FIGS. 3 to 11 has been described as installed on the dashboard, such as at the location X shown in FIG. 1, inside the vehicle superstructure AS. However, it is not limited thereto, but it may be installed on the floor at a location such as shown by Y in FIG. 1. Similarly, any one of the manipulatable units M of the respective constructions shown in FIGS. 11 to 13, FIG. 17, FIG. 18 and FIG. 19 can be installed on either the dashboard or the floor. Alternatively, the manipulatable unit M forming a part of the lock remote control embodying the present invention may be installed inside the vehicle superstructure at any suitable location generally considered convenient for the driver to gain access to the actuator of the manipulatable unit M.

Figure 20:
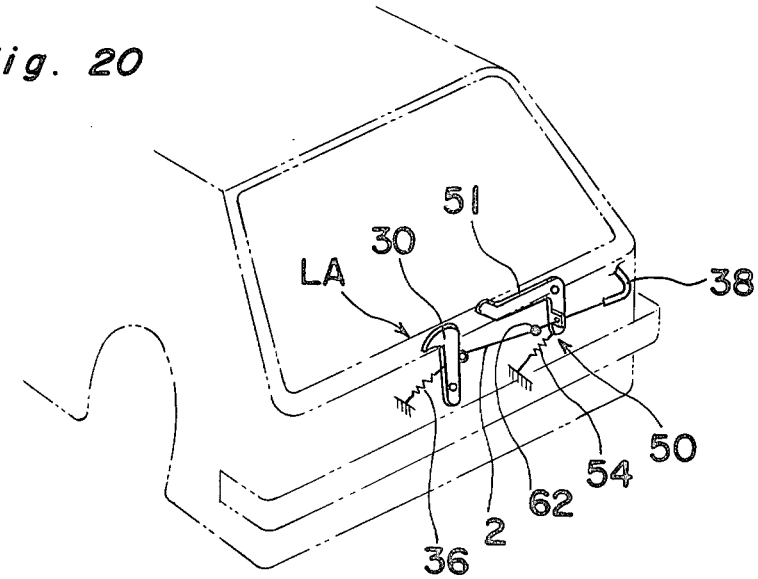
FIG. 20 is a schematic diagram showing an example wherein the lock assembly is installed in association with a vehicle back door.

In addition, the lock remote control embodying the present invention can be used in association with not only the trunk lid, such as hereinbefore described and shown, but also any other movable structuralelement such as a back door, a side door or a filler lid. An example of the lock remote control used in association with the back door of the vehicle superstructure is illustrated in FIG. 20. Referring to FIG. 20, it will readily be seen that the lock assembly LA including the reset means 50 shown therein essentially corresponds to that shown in FIG. 16.

Figure 21:
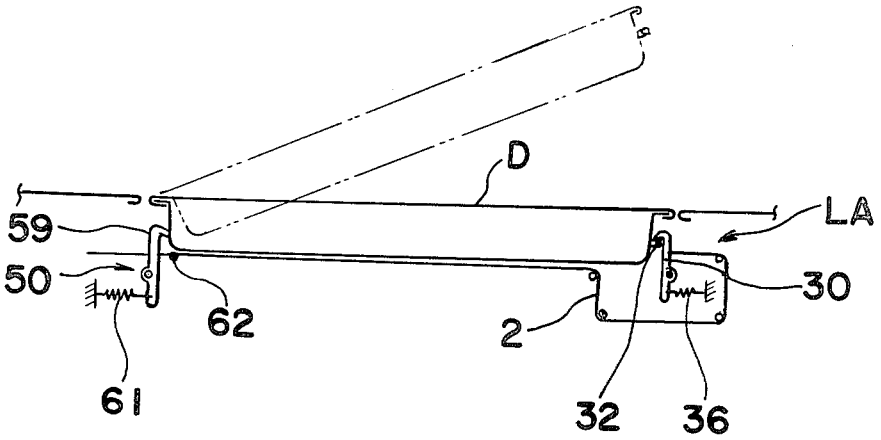
FIG. 21 is a schematic diagram showing an example wherein the lock assembly is installed in association with a vehicle side door.

Another example of the lock remote control used in association with the side door of a vehicle superstructure, such as a superstructure for a van or station wagon, is shown in FIG. 21. Referring to FIG. 21, the side door D is shown as supported for pivotal movement between a closed position such as shown by the solid line and an opened position such as shown by the broken line as is well known to those skilled in the art. The latch lever of the lock assembly LA and the reset lever of the reset means 50 employable in association with the side door of the type shown in FIG. 21 are each of a type having a substantially intermediate portion pivotally connected to a frame structure of the vehicle superstructure. In any event, it will readily be seen that, when the cable 2 is drawn in a direction close towards the manipulatable unit M, the latch lever 30 can be pivoted to the released position thereby with the hook disengaging the striker 32 secured to one side edge of the side door D and, when the side door D is moved from the closed position towards the opened position subsequent to the disengagement of the hook of the latch lever 30 from the striker 32, the reset lever 59 to which the stop element 62 is engaged draws the latch cable 20 by the action of the combined force of the springs 36 and 61 in a direction close towards the lock assembly LA to reset the latch lever 30 to the latched position in readiness for the subsequent locking of the side door D.

Figure 22:
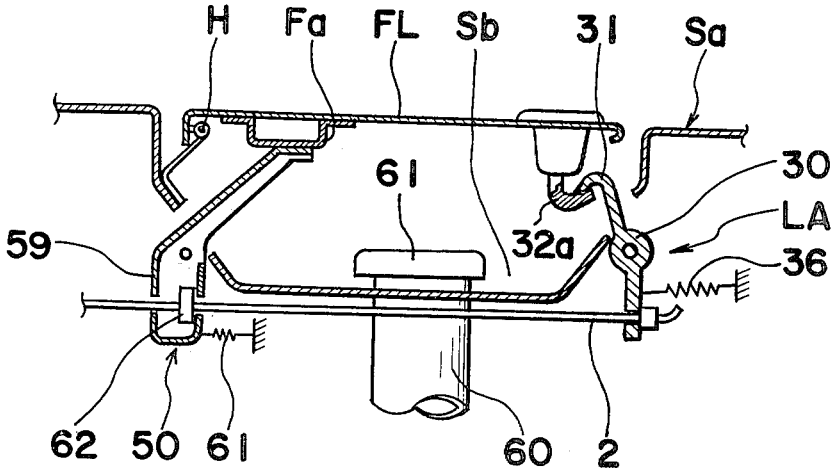
FIG. 22 is a sectional view showing an example wherein the lock assembly is installed in association with a vehicle filler lid.

The other example of the lock remote control used in association with the filler lid is shown in FIG. 22. Referring to FIG. 22, reference numeral 60 represents a fuel filler tube having one end communicated to a fuel tank (not shown) and the other end on which a cap 61 is threadingly mounted. Reference character Sa represents a side panel of the vehicle superstructure AS, which side panel Sa is shown as having an inward recess Sb in which the cap 61 and its associated end of the fuel filler tube 60 are situated. The opening of the inward recess Sb is adapted to be selectively closed and opened by a filler lid FL having one side edge hinged at H to the side panel Sa. At another side edge portion of the filler lid FL opposite to the hinged side edge thereof, the filler lid FL has a counter hook 32*a* rigidly secured thereto and protruding therefrom into the inward recess Sb, said counter hook 32*a* corresponding in function to the striker 32 shown in FIGS. 3 to 13 and 16.

The latch lever 31 shown in FIG. 22 has a substantially intermediate portion hingedly secured to the side panel Sa at a position on one side of the side panel Sa opposite to the filler lid FL. The end of the lever 31 which is formed with the hook 31 loosely protrudes through an aperture in the side panel Sa into the inward recess Sb while the other end of the lever 31 is rigidly connected with the latch cable 2. This latch lever 31 is normally biased to the latched position by the action of the biasing spring 36 with the hook 31 engaged to the counter hook 32*a* to lock the lid FL in the closed position as shown.

The reset lever 59 having one end constructed substantially in a manner as shown in FIGS. 14 and 15 has a substantially intermediate portion hinged through a suitable bracket to the side panel Sa at a position on one side of the side panel Sa opposite to the lid FL, the other end of which reset lever 59 loosely protruds through an aperture in the side panel Sa into the inward recess Sb and terminates in contact with an abutment Fa secured to the filler lid FL.

Figure 2:
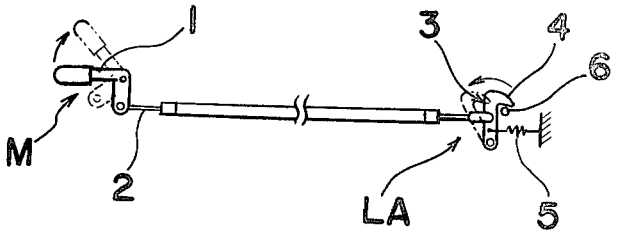
Fig. 2 Prior Art
FIG. 2 is a schematic diagram showing the prior art lock remote control.

The lock assembly LA including the reset means 50 shown in FIG. 2 operated in a manner substantially similar to that hereinbefore described and, therefore, the further description thereof is herein omitted for the sake of brevity.

Although the present invention has fully been described in connection with the various preferred embodiments thereof with reference to the accompanying drawings, it is to be noted that various changes and modifications are apparent to those skilled in the art. By way of example, the lock remote control system according to the present invention has been described as applied to an automobile superstructure. However, it may equally be used in association with a house door or any other movable structural element desired to be selectively locked and unlocked at a location remote from the location where such movable structural element is installed.

In addition, either a tension spring or a compression spring may equally be used for the various biasing springs. By way of example, the biasing spring used to bias the latch lever to the latched position may be either a tension spring such as shown or a compression spring or a leaf spring, although the position of the particular spring relative to the latch lever varies depending upon the type of a particular spring, such variation being to be considered a routine expedient within the purview of those skilled in the art.

In view of a relatively wide applicability of the lock remote control according to the present invention, the term "door assembly" used in the appended claims are to be understood as including the trunk lid, side door, engine room bonnet, back door and filler lid, whichever hingedly supported or slidingly supported.

In view of the above, these and other changes and modifications are to be included within the true scope of the present invention unless they depart therefrom.

What is claimed is:

1. A lock remote control device which comprises, in combination:

a lock assembly comprising a latch element for selectively locking and unlocking a movable structural element supported for movement between first and second positions, said latch element being supported in position for movement between released and latched positions, said movable structural element capable of being moved from the first position towards the second position when the latch element is moved from the latched position towards the released position, and a first biasing means exerting a first predetermined biasing force to urge said latch element to the latched position;

a latch cable having one end secured to the latch element;

a manipulatable unit positioned at a location spaced a distance from the location where the lock assembly is positioned, said manipulatable unit comprising a movable member supported for movement between third and fourth positions, said latch cable extending between said lock assembly and said manipulatable unit and having the other end secured to said movable member, a second biasing means exerting a second predetermined biasing force, larger than the first predetermined biasing force, to urge said movable member to assume the third position, and an actuator means responsive to an external force and operable to block the movement of the movable member from the fourth position towards the third position during the absence of the external pushing force and when the latch element is held in the latched position with the movable structural element held in the first position, and also operable, when the external force is applied thereto, to permit the movable member in the fourth position to move towards the third position by the action of the second biasing means thereby to draw the latch cable in such one direction as to move the latch element from the latched position towards the released position to unlock the movable structural element;

reset means supported for movement between fifth and sixth positions; and a third biasing means exerting a biasing force, the sum of said first and third predetermined biasing forces being larger than the second predetermined biasing force, said third predetermined biasing force acting on said reset means to urge the latter towards the sixth position, said reset means being so operatively associated with the movable structural element that, when the movable structural element is moved from the first position towards the second position with the latch element held in the released position, said reset means is moved to the sixth position as biased by the third biasing means and, when the movable structural element is moved from the second position back to the first position, said reset means is moved from the sixth position towards the fifth position against the third biasing means, said reset means when moved to the sixth position causing the latch element to move from the released position to the latched position with the movable member drawn to the fourth position through the latch cable against the second biasing means.

2. A lock remote control device as claimed in claim 1, wherein said movable structural element is a door assembly having a first portion hingedly supported to a fixed framework and a second portion opposite to said first portion, said second portion of the door assembly carrying an engagement member, and wherein said latch element is constituted by a pivotally supported latch lever having one end formed with a hook engageable with the engagement member.

3. A lock remote control device as claimed in claim 1, wherein said actuator means is supported for movement between inoperative and operative positions, said actuator when in the inoperative position, blocking the movement of the movable member from the fourth position towards the third position and, when in the operative position, permitting the movable member to move from the fourth position towards the third position as biased by the third biasing means, said actuator means including a fourth biasing means for urging the actuator means to the inoperative position, said actuator means, which has been moved to the operative position, being moved back to the inoperative position by the action of the fourth biasing means when the movable member is moved to the fourth position by the action of the combined first and third predetermined biasing forces overcoming the second predetermined biasing force.

4. A lock remote control device as claimed in claim 1, wherein said reset means comprises a substantially L-shaped reset lever pivotally supported at its substantially intermediate portion and having a first end engageable to the movable structural element in the first position and a second end operable to apply the third predetermined biasing force to the latch element only when the movable structural element is moved from the first position towards the second position while the latch element has been moved from the latched position towards the released position as a result of the application of the external force to the actuator means.

5. A lock remote control device as claimed in claim 2, wherein said reset means comprises a substantially elongated reset lever slidingly supported in position for movement between the fifth and sixth positions in a direction generally perpendicular to the door assembly in the first position, one end of said reset lever engageable to the door assembly in the first position and the other end of said reset lever receiving the third predetermined biasing force, a substantially intermediate portion of said reset lever being formed with an inclined cam so cooperatible with a projection extending from the latch element that, as the reset lever is moved linearly from the fifth position towards the six position, said inclined cam in contact with said projection causes the latch element to pivot from the released position towards the latched position while applying the third predetermined biasing force to said latch element.

* * * * *